US007918905B2

(12) United States Patent
Kremer et al.

(10) Patent No.: US 7,918,905 B2
(45) Date of Patent: Apr. 5, 2011

(54) METHOD FOR IMPROVING BIODIESEL FUEL

(75) Inventors: Lawrence N. Kremer, Woodland, TX (US); Jerry J. Weers, Richmond, TX (US); Jennifer D. Draper, Bryan, TX (US)

(73) Assignee: Baker Hughes Incorporated, Houston, TX (US)

( * ) Notice: Subject to any disclaimer, the term of this patent is extended or adjusted under 35 U.S.C. 154(b) by 817 days.

(21) Appl. No.: 11/749,853

(22) Filed: May 17, 2007

(65) Prior Publication Data

US 2008/0282605 A1 Nov. 20, 2008

(51) Int. Cl.
*C10L 1/222* (2006.01)

(52) U.S. Cl. ..... 44/422; 44/307; 44/308; 44/388; 44/434

(58) Field of Classification Search ..... 44/422, 44/412, 434, 307, 308, 388; 252/70, 402
See application file for complete search history.

(56) References Cited

U.S. PATENT DOCUMENTS

| | | | | |
|---|---|---|---|---|
| 5,205,945 | A * | 4/1993 | Cardis et al. | 508/274 |
| 5,250,081 | A * | 10/1993 | Habeeb et al. | 44/422 |
| 5,840,177 | A | 11/1998 | Weers et al. | |
| 6,013,175 | A | 1/2000 | Weers et al. | |
| 2005/0080280 | A1 * | 4/2005 | Yoo | 554/174 |
| 2005/0253110 | A1 * | 11/2005 | Chauhan et al. | 252/70 |
| 2007/0056213 | A1 * | 3/2007 | French et al. | 44/385 |

FOREIGN PATENT DOCUMENTS

EP 0538819 A2 4/1993

* cited by examiner

*Primary Examiner* — Ellen M McAvoy
*Assistant Examiner* — Latosha Hines
(74) *Attorney, Agent, or Firm* — Mossman Kumar & Tyler PC

(57) ABSTRACT

The addition of strong neutralizing amines to react with free fatty acid in biodiesel fuels that may be left from some synthesis routes can lower the total acid number (TAN) of the biodiesel fuel. Surprisingly, the strong neutralizing amines do not interfere with the biodiesel fuel itself which may be primarily fatty acid methyl esters. These strong neutralizing amines may also improve the oxidative stability of biodiesel fuels.

20 Claims, No Drawings

METHOD FOR IMPROVING BIODIESEL FUEL

TECHNICAL FIELD

The present invention relates to methods and compositions for improving biodiesel fuels, and more particularly to the use of strong amines to improve biodiesel fuels by reducing the acidic potential of biodiesel fuels as measured by total acid number and/or by improving their oxidative stability.

TECHNICAL BACKGROUND

It is well known that as the cost of crude oil increases, numerous efforts have been made to find and develop alternative fuels, particularly fuels that have a renewable, rather than a limited, source. Considerable effort has been expended researching potential fuels from regenerable biological sources, or biofuels. Biodiesel is a diesel fuel-equivalent, processed fuel derived from biological sources (such as vegetable oils), which may be used in unmodified diesel engine vehicles.

In the context herein, biodiesel fuels include, but are not necessarily limited to, alkyl esters of a fatty acid, typically either the ethyl ester or methyl ester of a fatty acid. Thus, many biodiesel fuels may be understood to contain fatty acid methyl esters (FAME). Most biodiesel fuel is presently made by transesterification of fatty acids. Biodiesel fuel may also be made from free fatty acids using an acid catalyst. There are other processes that use an ion-exchange resin catalyst. Most biodiesel fuels are made from vegetable oils, including, but not necessarily limited to rapeseed, soybean, cotton seed, corn, jotropha and the like oils. Some biodiesel is made from animal fats, including, but not limited to beef and pig tallow, chicken fat, fry grease, restaurant trap grease, fish oil, and the like. Efforts are also being made to blend FAME compounds to modify properties such as low temperature handling, for instance esters from palm and soybean oils or soybean and tallow oils (e.g. beef). The mixtures may be complex. All of these fall within the definition of biodiesel fuel herein. Non-esterified or straight vegetable oils (SVO) or straight waste vegetable oil (WVO) is not included in the definition of biodiesel fuels herein. However, biodiesel fuels as defined herein may include these non-esterified SVOs or WVOs in minor proportions (less than 50 volume %, and in another embodiment less than about 1%).

The biodiesel fuel B100 has a particular definition, including, among other parameters, a minimum ester content of 96.5 wt %. It may be made by transesterifying triglycerides from palm oil, soybean oil, tallow, rapeseed oil and/or waste oils with methanol in the presence of a catalyst.

Depending on the particular synthesis process, biodiesel fuels may contain acidic components or impurities, typically free fatty acids (FFA). These and other acid components in fuels are undesirable due to corrosivity concerns, oxidative stability and other problems. The acidity of the acid impurities in biodiesel fuels may be measured as an acid number or total acid number (TAN), which is defined as the amount of potassium hydroxide in milligrams that is needed to neutralize the acids in one gram of the fuel.

There is a need to reduce TAN in biodiesel fuels. It is desirable to discover a method and/or composition for reducing the true acidic potential, as represented by total acid number (TAN), of biodiesel fuel. The acidic potential may be defined herein as the ability or tendency to form acidic species in subsequent storage, transport, or processing of the biodiesel fuel.

SUMMARY

There is provided, in one non-limiting embodiment a method for improving a biodiesel fuel, comprising adding to the biodiesel fuel an additive or a composition that includes an additive, where the additive is a quaternary ammonium hydroxide and/or a quaternary ammonium alkoxide.

The quaternary ammonium hydroxide may have the formulae $R^1R^2R^3N^+OH\ OH^-$, $R^1R^2R^3N^+CH_2CHR^5OH\ OH^-$ and/or $R^1R^2R^3R^4N^+OH^-$, and the quaternary ammonium alkoxide may have the formula $R^1R^2R^3R^4N^+O^-$, where:

$R^1$ and $R^2$ may be alkyl groups of from 1 to about 18 carbon atoms, aryl groups of from 8 to about 18 carbon atoms and/or alkylaryl groups of from 7 to about 18 carbon atoms, $R^3$ may be alkyl groups of from 2 to about 18 carbon atoms, aryl groups of from 6 to about 18 carbon atoms or alkylaryl groups of from 7 to about 18 carbon atoms, provided, however, that $R^2$ and $R^3$ may be joined to form a heterocyclic ring including the N and optionally an oxygen atom, and $R^4$ may be H, alkyl groups of from 2 to about 18 carbon atoms, alkylaryl groups of from 7 to about 18 carbon atoms, $—(CH_2CH_2O)_nH$, where n is from 1 to about 18, $$—(CH_2\underset{\underset{CH_3}{|}}{C}HO)_m(CH_2CH_2O)_pH,$$

where m and p may independently be integers from 0 to about 18, except that the sum m+p is less than or equal to about 18, and $—CHR^5CHR^6Y$, where $R^5$ and $R^6$ may independently be hydrogen, alkyl groups of from 1 to about 18 carbon atoms, aryl groups of from 6 to about 18 carbon atoms or alkylaryl groups of from 7 to about 18 carbon atoms, and Y is a non-acidic group selected from the group consisting of —OH, $—SR^7$ and $—NR^7R^8$, where $R^7$ and $R^8$ may independently be hydrogen, alkyl groups of from 1 to about 18 carbon atoms, aryl groups of from 6 to about 18 carbon atoms or alkylaryl groups of from 7 to about 18 carbon atoms, and $R^5$ may be hydrogen, alkyl groups of from 1 to about 18 carbon atoms or alkylaryl groups of from 7 to about 18 carbon atoms.

Further, there is provided in another non-restrictive version an improved biodiesel fuel that contains a composition. The composition includes an additive such as a quaternary ammonium hydroxide and/or a quaternary ammonium alkoxide. The quaternary ammonium hydroxide may have the formulae $R^1R^2R^3N^+OH\ OH^-$, $R^1R^2R^3N^+CH_2CHR^5OH\ OH^-$ and/or $R^1R^2R^3R^4N^+OH^-$, and the quaternary ammonium alkoxide has the formula $R^1R^2R^3R^4N^+O^-$, where $R^1$, $R^2$, $R^3$, and $R^4$ are as defined above. At least some of the additive in the hydrocarbon composition has reacted with acidic components therein, e.g. free fatty acids.

DETAILED DESCRIPTION

In accordance with the present invention, it has been unexpectedly discovered that certain strong neutralizing amines, such as quaternary ammonium hydroxide additives and alkoxide additives are surprisingly effective at improving biodiesel fuels. This is particularly unexpected since in one non-limiting embodiment it is believed that the additives react with the free fatty acids (FFAs) in the biodiesel to form a benign compound that does not show up as part of the total acid number, but yet the additives do not react with the fatty acid methyl esters (FAMEs) present in the fuel, which would be detrimental. The exact mechanism by which the methods herein operate is not known, and thus the inventors herein do not wish to be limited by any particular explanation. The treatments with these additives may have at least two effects: (1) reducing acid potential as measured by total acid number (TAN) of the biodiesel fuel, and/or (2) increasing the oxidative stability of the biodiesel fuel. In the first case, the resultant TAN of the treated biodiesel is lowered. One or both of these may be improved as compared with a biodiesel fuel absent the additive. Improving the biodiesel fuels by this method is relatively more economical compared to some alternative methods.

It will also be appreciated that it is not necessary for all of the FFAs present in the hydrocarbon to be reacted and/or removed for the compositions and methods herein to be considered successful. The compositions and methods have accomplished a goal when the amounts of FFA are reduced as a consequence of being contacted with the compositions described herein.

The quaternary ammonium hydroxides may have the formulae $R^1R^2R^3N^+OH\ OH^-$, $R^1R^2R^3N^+CH_2CHR^5OH\ OH^-$ and/or $R^1R^2R^3N^+OH^-$, and the quaternary ammonium alkoxide may have the formula $R^1R^2R^3R^4N^+O^-$. $R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms.

$R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom.

$R^4$ is selected from the group consisting of H, alkyl groups of from 2 to about 18 carbon atoms, alkylaryl groups of from 7 to about 18 carbon atoms, $—(CH_2CH_2O)_nH$, where n is from 1 to about 18, $$—(CH_2\underset{\underset{CH_3}{|}}{C}HO)_m(CH_2CH_2O)_pH,$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms. In one non-restrictive version, $R^4$ is $—(CH_2CH_2O)_nH$ or $—CHR^5CHR^6Y$, where n, $R^5$, $R^6$ and Y are defined as above.

$R^5$ may be hydrogen, alkyl groups of from 1 to about 18 carbon atoms or alkylaryl groups of from 7 to about 18 carbon atoms.

In choline base, each of $R^1$, $R^2$ and $R^3$ is methyl. In some non-restrictive versions, $R^3$ may be the radical having at least two carbon atoms. In some non-limiting forms, $R^1$ and $R^2$ are alkyl groups of eighteen or fewer carbon atoms and in other non-restrictive embodiments lower alkyl groups of six carbons or fewer, especially three carbons or fewer and, alternatively, methyl groups. In another non-limiting embodiment, $R^3$ is a fatty group, such as from about eight to about eighteen carbon atoms, on the other hand about ten to about fourteen carbons atoms, such as a coco-group. However, alternatively, $R^3$ may be a benzyl group or substituted aryl groups, for example, alkylbenzyl groups such as methyl benzyl, or, less desirably, even may be an alkyl group of at least about two carbon atoms. In other non-restrictive embodiments, $R^2$ and $R^3$ may be joined to form a heterocyclic ring including the N and optionally an oxygen atom. In the latter case, a morpholine may be formed. Such ring products have been found to be less effective than some other products and may be more difficult to prepare by oxyalkylation of a tertiary amine.

$R^4$, as noted, corresponds to the formula $—(CH_2CH_2O)_nH$, where n is an integer from one to about eighteen, the formula $$—(CH_2\underset{\underset{CH_3}{|}}{C}HO)_m(CH_2CH_2O)_pH,$$

where m and p are integers from zero to about eighteen (independently selected except that m+p is less than or equal to about eighteen), or the formula $—CHR^5CHR^6Y$, where $R^5$ and $R^6$ and Y are defined as above. Inclusion of such $R^4$ groups in the quaternary compound has been found to increase the performance of the compound significantly over that of tetra-alkyl quaternary compounds. In one non-limiting embodiment, $R^4$ corresponds to the formula $—CHR^5CHR^6Y$, where $R^5$ and $R^6$ are hydrogen or lower alkyls of fewer than about six carbon atoms, in one non-restrictive version hydrogen, and Y is —OH.

However, when the quaternary compound is prepared by reacting a tertiary amine with an alkylene oxide to form a quaternary compound where $R^4$ is $—CH_2CH_2OH$, quaternary compounds are also formed where $R^4$ is the ether or polyether group $—(CH_2CH_2O)_nH$. Thus, a composition containing quaternary compounds where $R^4$ is $—(CH_2CH_2O)_nH$ often also contains quaternary compounds where $R^4$ is the ether or polyether group $—(CH_2CH_2O)_nH$. Generally, however, if the quaternary compound is prepared by oxyalkylating a tertiary amine, the amine is reacted with the alkylene oxide in a molar ratio of about 1:1 so that, while some amine remains unreacted thereby leaving some alkylene oxide available for polyether formation, typically the ether or polyether chains that do form are short; n being mostly one, two or three.

The quaternary ammonium hydroxides herein may be prepared by a variety of known techniques that will be readily apparent to those of ordinary skill in the art. For example, the quaternary ammonium hydroxides may be prepared by ion exchange techniques from readily available quaternary ammonium halides, such as quaternary ammonium chlorides. By such techniques, the quaternary ammonium halides may be passed through an ion exchange column for exposure to an ion exchange resin, exchanging the halide ion for $OH^-$ ions (or $Y^-$ ions where Y is as defined above and does not correspond to OH) from the column. Thus, according to this method for producing the hydroxide, the halide $R^1R^2R^3R^4N^+Z^-$, where $R^1$, $R^2$, $R^3$ and $R^4$ are as defined in the broader definition above and $Z^-$ is a halide, is brought into contact with an ion exchange resin bearing hydroxide ions to form $R^1R^2R^3R^4N^+OH^-$.

Alternatively, the quaternary ammonium hydroxides herein may be prepared by oxyalkylation of tertiary amines in the presence of water. Techniques for oxyalkylation of tertiary amines have been described, for example, in the European patent application 0 538 819 A3 to Roof, et al., but the European application requires the reaction to be carried out under anhydrous conditions. Anhydrous conditions were necessary for the formation of the internal ions of the European application. This reaction gives the quaternary ammonium alkoxides discovered to be useful herein. Quaternary ammonium ethoxides are formed when ethylene oxide is reacted with tertiary amines to give $R^1R^2R^3N^+CH_2CHR^4O^-$ where $R^4$ is H, and $R^1$, $R^2$ and $R^3$ are as defined previously.

The hydroxides have been discovered to be beneficial. Such compounds are formed when the oxyalkylation is carried out in the presence of water. And, surprisingly, it has been discovered that the reaction carried out in the presence of water results in yields of the quaternary ammonium hydroxide product that are significantly higher than the yields of quaternary ammonium internal ion resulting from the reaction carried out under anhydrous conditions. Moreover, carrying out the reaction in the presence of water allows the use of less oxide per amine than called for in the non-aqueous reaction of the European application of Roof et al. (that is, a 1:1 molar ratio may be employed as opposed to bubbling the oxide through the amine as called for by Roof et al.). In addition, the aqueous reaction proceeds much faster than does the non-aqueous reaction and so the quaternary product may be formed in much less time. Where Y of $R^4$ is a non-acidic group other than $OH^-$, a similar reaction may be carried out with, for example, an alkylene sulfide or alkyleneimine instead of an alkylene oxide.

Thus, it has been discovered that if the oxyalkylation reaction is carried out in the presence of water, the resulting quaternary ammonium hydroxides not only are more effective additives in certain non-limiting cases than are the internal ions (the quaternary ammonium alkoxides) that would have been produced had the reaction taken place in the absence of water, but also are produced in higher yields than the internal ions would have been.

Accordingly, in more detail, where $R^4$ of the quaternary ammonium hydroxide $R^1R^2R^3R^4N^+ OH^-$ is hydroxyethyl or hydroxypropyl, or if $R^4$ is an ether or polyether group as described above, the hydroxide may be prepared by reacting a tertiary amine such as of the form $R^1R^2R^3N$ with an alkylene oxide, in the presence of water. The alkylene oxide may be propylene oxide, but ethylene oxide is useful in one non-limiting embodiment. In alternative embodiments where the quaternary ammonium compound $R^1R^2R^3R^4N^+$ is not a hydroxide, but $R^4$ corresponds to the formula —$CHR^5CHR^6Y$, where $R^5$ and $R^6$ are defined above and Y is a non-acidic group corresponding to the formula —$SR^7$ or —$NR^7R^8$, an alkylene sulfide or alkyleneimine, respectively, may be substituted for the alkylene oxide and otherwise the same procedures may be followed.

$R^1$, $R^2$ and $R^3$ of the tertiary amine are as defined above. In one non-limiting embodiment, however, $R^1$ is methyl and alternatively $R^2$ is also methyl. Although $R^2$ and $R^3$ may be joined to form a heterocyclic ring including the N and optionally an oxygen atom, such as to form a morpholine derivative, such compositions have been found to be more difficult to oxyalkylate without the offset of producing more potent additives and so in some configurations, $R^2$ and $R^3$ are not joined. In one non-restrictive version, $R^3$ is a fatty group of from about six to about twelve carbon atoms.

The reaction may be carried out in an aqueous solvent. For example, the solvent may comprise about 50% by weight to about 95%, by weight alcohol such as isopropanol or, in one useful embodiment, methanol, and about 5% by weight to about 50% by weight water. A typical solvent formulation, therefore, might comprise, by weight, two parts solvent to one part water.

The active ingredients may make up about 70% by weight of the reaction mixture (the remaining 30% being solvent). In one non-limiting method of preparation, the tertiary amine is stirred in the solvent and the system is pressurized with alkylene oxide added in a molar ratio of about 1:1 to the amine. Generally, the molar ratio is in the range of from about 1:1 to about 1.5:1 alkylene oxide to amine. The reaction may be carried out at a temperature typically under about 70° C., in one non-limiting embodiment about 40° C. to about 50° C., with continuous stirring and its completion is signaled by a drop in pressure to about atmospheric. The resulting mixture, aside from unreacted solvent, is a combination of the quaternary compounds where the $R^4$s are of the formulae —$CH_2CH_2OH$ and —$(CH_2CH_2O)_nH$, where n is as defined above, unreacted amine, and glycols formed from reaction of the alkylene oxide and water. Other quaternary ammonium hydroxides where $R^4$ corresponds to the formula $$—(CH_2\underset{\underset{CH_3}{|}}{C}HO)_m(CH_2CH_2O)_pH,$$

or the formula —$CHR^5CHR^6Y$ where m, p, $R^5$, $R^6$ and Y are as defined above, may be prepared by similar techniques that will be readily apparent to those of ordinary skill in the art.

Other strong amines may perform in the methods described herein, however most amines are not expected to work because they must form a stronger bond with the FFA than is formed by the KOH used in the TAN titration.

The resulting additive, be it quaternary ammonium hydroxide or quaternary ammonium alkoxide may be added to the biodiesel fuel to be treated by standard techniques, such as by injection or simple pouring and it may be dispersed throughout the fuel by stirring or other agitation. The additive is incorporated at a level sufficient to react with the FFA to a desired degree and will depend on the FFA content of the biodiesel and the corresponding stoichiometry. In practice, one would dose test bottles with varying amounts of the additive to determine how much is required to bring the TAN within an acceptable value. In one non-restrictive version, the additive is added to the biodiesel fuel at least equivalent to 0.01 mg KOH/g of the biodiesel fuel. Alternatively, the biodiesel fuel including the additive has reduced acid potential as measured by TAN of between about 0.01 and about 0.9 mg KOH/g of biodiesel fuel. In another non-limiting embodiment, about 1000 ppm additive results in a reduction in TAN of 0.1 unit. In an alternative version, typical additive levels may be on the order of about 20 to about 10,000 ppm, in one non-limiting embodiment from a lower threshold of about 100 independently to an upper threshold of about 5,000, ppm based on the weight of the medium to be treated, alternatively from a lower threshold of about 500 independently to an upper threshold of about 1000 ppm. The reaction of the additive with the FFA may be stoichiometric, in one non-limiting explanation, thus the proportions could be defined as 0.5:1 to 1:0.5 mole equivalents of additive to FFA.

The liquid medium treated may be any biodiesel fuel as previously defined. The biodiesel fuels may contain other oxygenated compounds besides esters, such as alcohols, glycols, ethers and the like and mixtures thereof.

Effective treatment may be carried out at the ambient temperature of the biodiesel fuel (e.g., about 20° C. for stored fuel), but the performance of the additive is expected to be effective at higher temperatures such as about 50° C. to about 75° C. The additive tends to decompose at even higher temperatures, such as at about 100° C. However, the decomposition at such temperatures occurs relatively slowly while the time for the reaction between the additive and the FFA is relatively short, generally requiring only several hours to reduce the FFA level substantially. Thus, the additive may still be employed at such elevated temperatures with good results.

It has been found that the additives herein reduce acid potential of the biodiesel fuels as measured by TAN, particularly as compared to other amines tested. The additives also increase the oxidative stability of the biodiesel fuels, and this effect appears to be related to other factors, but possibly including reactions with FFAs. However, the effect of reducing TAN and increasing oxidative stability may not be related. In one non-limiting embodiment, it appears that it does not require as much additive to control oxidative stability as it does to lower TAN.

In one non-restrictive version, the oxidative stability of a biodiesel fuel is measured using the rancimat test, which is a test that accelerates oxidation of the esters in the fuel. This test involves passing air through a sample of the ester at an elevated temperature. As oxidation occurs, volatile organic acids are formed which are swept from the sample and collected in a downstream cell. The conductivity of the solution in the cell is monitored during the test. It is determined when enough oxidation of the ester has occurred that sufficient volatile acids are formed and swept from the sample to cause a spike in conductivity of the cell. The method takes the maximum second derivative of the conductivity curve as the induction period. The longer that the sample can be heated/sparged with air before this spike in volatile acid formation occurs, the more stable the biodiesel fuel is.

Stability is a concern with biodiesel fuel storage. As noted previously, many of the feedstocks for the methyl esters are oils like rapeseed or soybean oils. The fatty acid chains in these oils contain unsaturation (oleic, linoleic, linolenic etc.) which is subject to oxidation. It does not take much unsaturation in the oils to be a potential problem. Palm oil contains much less of these materials, but will still oxidize and fail the test. Stability is important because the methyl/ethyl esters tend to discolor and eventually form solids as a result of oxidation during storage. The potential solids/discoloration of the biodiesel fuels makes them less attractive as a fuel to an end user and can potentially cause engine issues such as filter or injector fouling.

The following examples describe certain specific embodiments of the invention. Other embodiments within the scope of the claims herein will be apparent to one skilled in the art from consideration of the specification or practice of the methods as disclosed herein. It is intended that the specification, together with the examples, be considered exemplary only, with the scope and spirit of the invention being indicated by the claims which follow the examples. In the examples, all percentages are given on a weight basis unless otherwise indicated.

EXPERIMENTAL

TAN Reduction Test Protocol

Samples of a biodiesel fuel were treated with various neutralizing amines to see if they would lower the TAN values. The treated samples were then submitted to analysis to measure TAN. Most of the amine products were ineffective, however Amine D could reduce the TAN to less than 0.01. The TAN levels achieved were less than one-tenth of the starting value of 0.10. Amine A is bis-di-N-butyl amino methane. Amine B is 35.5% dimethyl ethanolamine in a hydrocarbon. Amine C is 52% monoethanolamine in water. Amine D is dimethyl (2-hydroxyethyl) coco ammonium hydroxide, which falls within the definition of a suitable additive herein.

TABLE I

Use of Amines to Reduce TAN

| Ex. | Product | Dosage | TAN |
|---|---|---|---|
| 1 | Blank | 0 | 0.10 |
| 2 | Amine A | 2000 ppm | 0.11 |
| 3 | Amine B | 2000 ppm | 0.10 |
| 4 | Amine C | 2000 ppm | 0.05 |
| 5 | Amine D | 1000 ppm | 0.04 |
| 6 | Amine D | 2000 ppm | <0.01 |
| 7 | Amine D | 4000 ppm | <0.01 |

Oxidative Stability

Amine D was tested on two different biodiesel fuels, one which was 100% soybean oil methyl ester, and a second one which was 100% palm oil methyl ester. The test method was the conventional rancimat test using a Metrohm Ltd. 743 Rancimat machine. From the results shown in Table II, it may be seen that increasing doses of Amine D desirable increased the induction time, indicating that Amine D effectively improved the oxidative stability of the biodiesel fuels.

TABLE II

Use of Amine D to Improve Oxidative Stability

| Ex. | Biodiesel | Chemical | Dosage (ppm) | Induction Period at 110° C. (hours) |
|---|---|---|---|---|
| 8 | Soy | Blank | 0 | 3.4 |
| 9 | Soy | Amine D | 1000 | 6 |
| 10 | Soy | Blank | 0 | 4.6 |
| 11 | Soy | Amine D | 500 | 7.1 |
| 12 | Soy | Amine D | 1000 | 9.9 |
| 13 | Soy | Blank | 0 | 5.1 |
| 14 | Soy | Amine D | 250 | 7 |
| 15 | Soy | Amine D | 500 | 8.9 |
| 16 | Soy | Amine D | 750 | 9.8 |
| 17 | Palm | Blank | 0 | 6.9 |
| 18 | Palm | Amine D | 250 | 8.3 |
| 19 | Palm | Amine D | 500 | >8 |
| 20 | Palm | Amine D | 750 | >8 |

As used herein, the word "comprising" as used throughout the claims is to be interpreted to mean "including but not limited to".

In the foregoing specification, the invention has been described with reference to specific embodiments thereof. It has been demonstrated as effective in providing methods and compositions for improving biodiesel fuels, particularly lowering TAN values and increasing oxidative stability. However, it will be evident that various modifications and changes can be made thereto without departing from the broader spirit or scope of the invention as set forth in the appended claims.

Accordingly, the specification is to be regarded in an illustrative rather than a restrictive sense. For example, specific combinations of quaternary ammonium hydroxide, quaternary ammonium alkoxide, and other components falling within the claimed parameters, but not specifically identified or tried in a particular composition or under specific conditions, are anticipated to be within the scope of this invention.

What is claimed is:

1. A method for improving a biodiesel fuel comprising fatty acid methyl esters and free fatty acids, the method comprising adding to the biodiesel fuel an additive selected from the group consisting of a quaternary ammonium hydroxide, a quaternary ammonium alkoxide, and mixtures thereof, where the quaternary ammonium hydroxide has the formula selected from the group consisting of $R^1R^2R^3N^+OH\ OH^-$, $R^1R^2R^3N^+CH_2CHR^5OH\ OH^-$ and $R^1R^2R^3R^4N^+OH^-$ and the quaternary ammonium alkoxide has the formula $R^1R^2R^3R^4N^+O^-$, and mixtures thereof, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18, $$—(CH_2\underset{\underset{CH_3}{|}}{CHO})_m(CH_2CH_2O)_pH,$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms and alkylaryl groups of from 7 to about 18 carbon atoms.

2. The method of claim 1 where the additive is added to the biodiesel fuel at least equivalent to 0.01 mg KOH/g of the biodiesel fuel.

3. The method of claim 1 where the additive is added to the biodiesel fuel in an amount from about 20 to about 10,000 ppm.

4. The method of claim 1 where $R^4$ is $—(CH_2CH_2O)_nH$ where n is as defined therein.

5. The method of claim 1 where the biodiesel fuel is improved by a characteristic selected from the group consisting of:

reduced acid potential as measured by total acid number (TAN);

increased oxidative stability; and both, as compared with a biodiesel fuel absent the additive.

6. The method of claim 5 where the biodiesel fuel has reduced acid potential as measured by TAN of between about 0.01 and about 0.9 mg KOH/g of biodiesel fuel.

7. A method for improving a biodiesel fuel comprising fatty acid methyl esters and free fatty acids with a minimum ester content of 96.5 wt %, the method comprising adding to the biodiesel fuel from about 20 to about 10,000 ppm of an additive, based on the biodiesel fuel, where the additive is selected from the group consisting of a quaternary ammonium hydroxide, a quaternary ammonium alkoxide, and mixtures thereof, where the quaternary ammonium hydroxide has the formula selected from the group consisting of $R^1R^2R^3N^+OH\ OH^-$, $R^1R^2R^3N^+CH_2CHR^5OH\ OH^-$ and $R^1R^2R^3R^4N^+OH^-$ and the quaternary ammonium alkoxide has the formula $R^1R^2R^3R^4N^+O^-$, and mixtures thereof, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18, $$—(CH_2\underset{\underset{CH_3}{|}}{CHO})_m(CH_2CH_2O)_pH,$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms and alkylaryl groups of from 7 to about 18 carbon atoms, where the biodiesel fuel is improved by a characteristic selected from the group consisting of: reduced acid potential as measured by total acid number (TAN) of; increased oxidative stability; and both, as compared with a biodiesel fuel absent the additive.

8. The method of claim 7 where the additive is added to the biodiesel fuel at least equivalent to 0.01 mg KOH/g of the biodiesel fuel.

9. The method of claim 7 where $R^4$ is $—(CH_2CH_2O)_nH$ where n is as defined therein.

10. The method of claim 7 where the biodiesel fuel has reduced acid potential as measured by TAN of between about 0.01 and about 0.9 mg KOH/g of biodiesel fuel.

11. An improved biodiesel fuel comprising:

fatty acid methyl esters;

free fatty acids;

an additive selected from the group consisting of a quaternary ammonium hydroxide, a quaternary ammonium alkoxide, and mixtures thereof, where the quaternary ammonium hydroxide has the formula selected from the group consisting of $R^1R^2R^3N^+OH\ OH^-$, $R^1R^2R^3N^+CH_2CHR^5OH\ OH^-$ and $R^1R^2R^3R^4N^+OH^-$ and the quaternary ammonium alkoxide has the formula $R^1R^2R^3R^4N^+O^-$, and mixtures thereof, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18

$$—(CH_2\underset{\underset{CH_3}{|}}{C}HO)_m(CH_2CH_2O)_pH,$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms and alkylaryl groups of from 7 to about 18 carbon atoms, where at least some of the additive has reacted with the $H_2S$ and/or mercaptan.

12. The improved biodiesel fuel of claim 11 where the additive present is at least equivalent to 0.01 mg KOH/g of the biodiesel fuel.

13. The improved biodiesel fuel of claim 11 where the additive is present in an amount from about 20 to about 10,000 ppm.

14. The improved biodiesel fuel of claim 11 where $R^4$ is $—(CH_2CH_2O)_nH$ where n is as defined therein.

15. The improved biodiesel fuel of claim 11 where the biodiesel fuel is improved by a characteristic selected from the group consisting of:

reduced acid potential as measured by total acid number (TAN);

increased oxidative stability of the biodiesel fuel; and both, as compared with a biodiesel fuel absent the additive.

16. The improved biodiesel fuel of claim 15 where the biodiesel fuel has reduced acid potential as measured by TAN of between about 0.01 and about 0.9 mg KOH/g of biodiesel fuel.

17. An improved biodiesel fuel comprising:

fatty acid methyl esters, where the biodiesel fuel has a minimum ester content of 96.5 wt %;

free fatty acids;

about 20 to about 10,000 ppm of an additive, based on the biodiesel fuel, where the additive is selected from the group consisting of a quaternary ammonium hydroxide, a quaternary ammonium alkoxide, and mixtures thereof, where the quaternary ammonium hydroxide has the formula selected from the group consisting of $R^1R^2R^3N^+OH\ OH^-$, $R^1R^2R^3N^+CH_2CHR^5OH\ OH^-$ and $R^1R^2R^3R^4N^+OH^-$ and the quaternary ammonium alkoxide has the formula $R^1R^2R^3R^4N^+O^-$, and mixtures thereof, where:

$R^1$ and $R^2$ are independently selected from the group consisting of alkyl groups of from 1 to about 18 carbon atoms, aryl groups of from 8 to about 18 carbon atoms and alkylaryl groups of from 7 to about 18 carbon atoms, $R^3$ is selected from the group consisting of alkyl groups of from 2 to about 18 carbon atoms, aryl groups of from 6 to about 18 carbon atoms and alkylaryl groups of from 7 to about 18 carbon atoms, provided, however, that $R^2$ and $R^3$ may be joined to form a heterocyclic ring including the N and optionally an oxygen atom, $R^4$ is selected from the group consisting of hydrogen, alkyl groups of from 2 to about 18 carbon atoms, alkylaryl groups of from 7 to about 18 carbon atoms, $—(CH_2CH_2O)_nH$, where n is from 1 to about 18

$$—(CH_2\underset{\underset{CH_3}{|}}{C}HO)_m(CH_2CH_2O)_pH,$$

where m and p are independently selected from integers from 0 to about 18, except that the sum m+p is less than or equal to about 18, and $—CHR^5CHR^6Y$, where $R^5$ and $R^6$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and Y is a non-acidic group selected from the group consisting of —OH, $—SR^7$ and $—NR^7R^8$, where $R^7$ and $R^8$ are independently selected from the group consisting of hydrogen, alkyl groups of from 1 to about 18 carbon atoms, aryl groups of from 6 to about 18 carbon atoms and alkylaryl groups of from 7 to about 18 carbon atoms, and $R^5$ is selected from the group consisting of hydrogen, alkyl groups of from 1 to about 18 carbon atoms and alkylaryl groups of from 7 to about 18 carbon atoms, where at least some of the additive has reacted with the $H_2S$ and/or mercaptan, where the biodiesel fuel is improved by a characteristic selected from the group consisting of: reduced acid potential as measured by total acid number (TAN); increased oxidative stability of the biodiesel fuel; and both, as compared with a biodiesel fuel absent the additive.

18. The improved biodiesel fuel of claim 17 where the additive is present at least equivalent to 0.01 mg KOH/g of the biodiesel fuel.

19. The improved biodiesel fuel of claim 17 where $R^4$ is $—(CH_2CH_2O)_nH$ where n is as defined therein.

20. The improved biodiesel fuel of claim 17 where the biodiesel fuel has reduced acid potential as measured by TAN of between about 0.01 and about 0.9 mg KOH/g of biodiesel fuel.

* * * * *